US009943167B2

(12) United States Patent
Lucas

(10) Patent No.: US 9,943,167 B2
(45) Date of Patent: Apr. 17, 2018

(54) TRIM PROFILE COVERING FIXTURE

(71) Applicant: Grass GmbH, Höchst (AT)

(72) Inventor: Tim Lucas, Leinfelden-Echterdingen (DE)

(73) Assignee: Grass GmbH, Hochst (AT)

( * ) Notice: Subject to any disclaimer, the term of this patent is extended or adjusted under 35 U.S.C. 154(b) by 0 days.

(21) Appl. No.: 14/872,705

(22) Filed: Oct. 1, 2015

(65) Prior Publication Data

US 2016/0095435 A1 Apr. 7, 2016

(30) Foreign Application Priority Data

Oct. 2, 2014 (DE) ..... 20 2014 008 003 U

(51) Int. Cl.

| | |
|---|---|
| ***A47B 88/00*** | (2017.01) |
| ***A47B 95/02*** | (2006.01) |
| ***A47B 96/00*** | (2006.01) |
| ***A47B 88/90*** | (2017.01) |
| ***A47B 88/95*** | (2017.01) |
| ***A47B 88/40*** | (2017.01) |

(52) U.S. Cl.

CPC ..... *A47B 88/0051* (2013.01); *A47B 88/40* (2017.01); *A47B 88/941* (2017.01); *A47B 88/95* (2017.01); *A47B 95/02* (2013.01); *A47B 96/00* (2013.01); *A47B 2210/00* (2013.01); *A47B 2220/00* (2013.01)

(58) Field of Classification Search

CPC ..... A47B 88/0051; A47B 88/0014; A47B 88/0044; A47B 2088/0059; A47B 2088/0062; A47B 2088/007; A47B 2210/00; A47B 2210/01; A47B 2210/02; A47B 2210/09; A47B 2220/00; A47B 2220/0058; A47B 2220/02; A47B 2230/0029; A47B 2230/0033; A47B 2230/0037; A47B 2230/0044; A47B 2230/0048; A47B 2230/0051

USPC ..... 312/348.1, 348.2, 348.4

See application file for complete search history.

(56) References Cited

U.S. PATENT DOCUMENTS

| | | | | |
|---|---|---|---|---|
| 2,801,895 A * | 8/1957 | Gass | ..... | A47B 88/0014 211/186 |
| 3,391,967 A * | 7/1968 | Schreyer | ..... | A47B 63/00 312/111 |
| 3,726,579 A * | 4/1973 | Ullman, Jr. | ..... | A47B 88/0018 312/195 |

(Continued)

FOREIGN PATENT DOCUMENTS

| | | | | |
|---|---|---|---|---|
| AT | 506440 A1 * | 9/2009 | ..... | A47B 88/0044 |
| DE | 8026071 | 2/1984 | | |

(Continued)

*Primary Examiner* — Andrew M Roersma

(74) *Attorney, Agent, or Firm* — Edell, Shapiro & Finnan LLC

(57) ABSTRACT

There is provided a trim profile covering fixture with at least one side covering element with a longitudinal axis, for a trim profile of a movable furniture component, in particular a drawer, wherein the side covering element has at least one mounting projection which may be inserted into an assigned mounting location on the trim profile and is held there in the inserted state, wherein the mounting projection has at least one clamping jaw which may be braced by an inner surface of the mounting location.

18 Claims, 5 Drawing Sheets

(56) References Cited

U.S. PATENT DOCUMENTS 3,846,003 A * 11/1974 Rockwell ..... A47B 47/042 312/204
3,926,491 A * 12/1975 Greer ..... A47B 88/0014 29/417
4,090,753 A * 5/1978 Rock ..... A47B 88/956 248/243
4,601,523 A * 7/1986 Wenzlick ..... A47B 88/0014 312/330.1
5,597,221 A * 1/1997 Grieser ..... A47B 88/0014 312/348.1
6,179,399 B1 * 1/2001 Brustle ..... A47B 88/0051 312/263
6,287,044 B1 * 9/2001 Huber ..... F16B 12/14 403/297
6,474,901 B1 * 11/2002 Thurston ..... F16B 12/50 403/381
6,712,573 B1 * 3/2004 Huber ..... F16B 12/14 403/282
7,008,159 B2 * 3/2006 Dendo ..... F16B 5/0258 411/182
7,540,576 B1 * 6/2009 Ross ..... A47B 88/00 312/348.1
2013/0154463 A1 * 6/2013 Henscheid ..... A47B 88/0014 312/330.1
2014/0167586 A1 * 6/2014 Schallert ..... A47B 88/04 312/330.1
2014/0184047 A1 * 7/2014 Grimm ..... A47B 88/04 312/319.1

FOREIGN PATENT DOCUMENTS

DE 102008035293 A1 * 2/2010 ..... A47B 47/0075
DE 102008057071 A1 * 5/2010 ..... A47B 88/0014
DE 202013003393 U1 * 7/2014 ..... A47B 88/0051
WO WO2011151053 A1 * 12/2011 ..... A47B 88/00
WO WO2012028489 A1 * 3/2012 ..... A47B 88/00
WO WO 2014075813 A1 * 5/2014 ..... A47B 88/0014

* cited by examiner

TRIM PROFILE COVERING FIXTURE

CROSS REFERENCE TO RELATED APPLICATIONS

This application claims foreign priority under 35 U.S.C. § 119(a)-(d) to Application No. DE 20 2014 008 003.8 filed on Oct. 2, 2014, the entire contents of which are hereby incorporated by reference.

FIELD OF THE INVENTION

The invention relates to a trim profile covering fixture with at least one side covering element with a longitudinal axis for a trim profile of a movable furniture component, in particular a drawer.

BACKGROUND

Such trim profile covering fixtures are already known from the prior art in a variety of forms. There is a need to fix a trim profile (e.g., a panel), which may be a front panel or an inside drawer panel, to the rest of the movable furniture component, using a trim fastener. The fixing of the trim profile to the rest of the drawer must be effected in such a way that, in handling of the movable furniture component by the user, tensile and compressive forces on the trim profile, acting for example when a drawer is slid in and out, are transferred reliably to the rest of the movable furniture component. For this purpose it is already known that trim profiles may be made as so-called core profiles, for example of aluminium. With this design, however, several drilled holes are needed to attach the trim fastener. This necessitates an additional processing step, resulting in an adverse effect on costs of production.

It is also necessary to clad a trim profile at the side using side covers. Side covering elements are used for this purpose.

The problem is therefore to create a trim profile covering fixture of the type described above which has a trim profile which is inexpensive to produce, which may be fastened to the rest of the movable furniture component, if applicable using a trim fastener, in a simple manner, and to which a side covering element which can be produced at low cost may be attached, also in a simple manner.

SUMMARY

The trim profile covering fixture according to the invention has at least one side covering element with a longitudinal axis, for a trim profile of a movable furniture component, in particular a drawer, wherein the side covering element has at least one mounting projection which may be inserted into an assigned mounting location on the trim profile and is held there in the inserted state, wherein the mounting projection has at least one clamping jaw which may be braced by an inner surface of the mounting location.

Mounting of the side covering element is therefore effected in a simple manner by means of at least one clamping jaw which, after insertion in the mounting location on the trim profile, may be braced by the inner surface of the mounting location either manually or with the aid of an actuator. The bracing may be effected for example by spreading apart of the clamping jaw.

The trim profile may involve for example a front panel or an inside drawer panel. In an especially preferred manner, the trim profile is a coreless profile, for example a coreless aluminium profile. Expediently the mounting location is provided on the rear of the trim profile. Because of the mounting location already provided on the trim profile, it is no longer necessary to drill holes for the fixing of a trim fastener or for attaching the side covering elements to the sides of the trim profile.

In a development of the invention, the side covering element has at least one mounting interface for the fixing of a trim fastener, which in turn is used to mount the trim profile on the rest of the movable furniture component. The side covering element is also multi-functional, serving on the one hand for cladding the side face of the trim profile, and on the other hand for the attachment of a trim fastener, by which the trim profile may then be mounted on the rest of the movable furniture component. In the case of a drawer, the trim profile may be mounted with two side covering elements fastened to it, each carrying a trim fastener, for example to an assigned side frame of the drawer.

In a development of the invention, the trim profile covering fixture includes at least one trim fastener, which is attached to the side covering element at the assigned interface. In the case of a movable furniture component in the form of a drawer, therefore, two side covering elements and trim fasteners in each case attached to the associated mounting interfaces are provided.

In an especially preferred manner, the mounting interface is connected to the mounting projection in such a way that an actuator serving for bracing of the clamping jaw also effect the fixing of the trim fastener to the mounting interface. The actuator may for example comprise fixing screws, serving for fixing of the trim fastener at the associated interface on the side covering element, while at the same time providing bracing of the clamping jaw at the inner face of the assigned mounting location.

In a development of the invention, the side covering element has at least one recess, aligned transversely to the longitudinal axis, in which the mounting projection is located.

In an especially preferred manner, the mounting projection has a base section on which at least one clamping jaw is movably mounted using bearing means. The clamping jaw can therefore be shifted between an insertion position and a clamping position braced against the inner face of the mounting location. This may be effected for example by screwing in the fixing screws.

It is possible to have two clamping jaws, movable in opposite directions to one another, mounted on the base section by use of the bearing means. In principle, though, the attachment of a single clamping jaw to the base section is also conceivable.

In a development of the invention, the base section has a T-shaped cross-section, which in turn is equipped with a neck section and two leg sections oriented opposite to one another starting from the neck section. Expediently the T-shaped base section is assigned a C-profile-type mounting location on the trim profile in such a way that, in the inserted state of the base section, the two leg sections are engaged from behind by profile sections of the mounting location.

In a development of the invention, the mounting interface or interfaces has or have a fixing hole, which extends into the base section of the mounting projection in the area of the clamping jaw or jaws. Through the fixing hole, as mentioned above, a fixing screw may be inserted and used on the one hand to fix the trim fastener to the mounting interface, and on the other hand to clamp the clamping jaw in its clamping position at the inner surface of the mounting location.

In a development of the invention, the mounting interface or interfaces has or have a mounting projection which extends over a side face of the side covering element. The mounting projection may also for example have a T-shaped cross-section, so that it may be engaged from behind by a corresponding C-profile-type mounting section of the trim fastener.

In an especially preferred manner, the side covering element is rail-like in form, with a base section of elongated shape and with a rail section which is connected to a longitudinal edge of the base section, in particular in one-piece, wherein the mounting projection or projections is or are formed on the base section.

In a development of the invention, the trim profile covering fixture includes a trim profile of a movable furniture component, for example a drawer. The trim profile may be in the form of a front panel or an inside trim profile or inside drawer panel.

In an especially preferred manner, the trim profile has on its rear at least one mounting location in the form of a C-profile rail. Expediently several C-profile rails are provided, for example two in number, with one mounting projection of the side covering element assigned in each case.

The invention also includes a furniture component, in particular a drawer, with a trim profile and a trim profile covering fixture for the trim profile, wherein the trim profile covering fixture is designed according to any of claims 1 to 13.

Finally the invention also includes a piece of furniture, with a furniture component, in particular a drawer, guided relative to a furniture body of the piece of furniture, wherein the furniture component has a trim profile and a trim profile covering fixture for the trim profile, wherein the trim profile covering fixture is designed according to any of claims 1 to 14.

DETAILED DESCRIPTION

FIGS. 1 to 6 show a preferred embodiment of the trim profile covering fixture 11 according to the invention. The trim profile covering fixture 11 is shown by way of example with the aid of such a fixture used in connection with a movable furniture component in the form of a drawer. In principle, though, it would also be possible to use the trim profile covering fixture 11 on other movable furniture components, for example other furniture drawers, furniture flaps or the like.

The trim profile covering fixture 11 includes in the typical case a trim profile 12 used in the example of an inside trim profile of an inside drawer compartment of a drawer. It is however also conceivable to use the trim profile covering fixture 11 on a front panel of a drawer.

Figure 3:
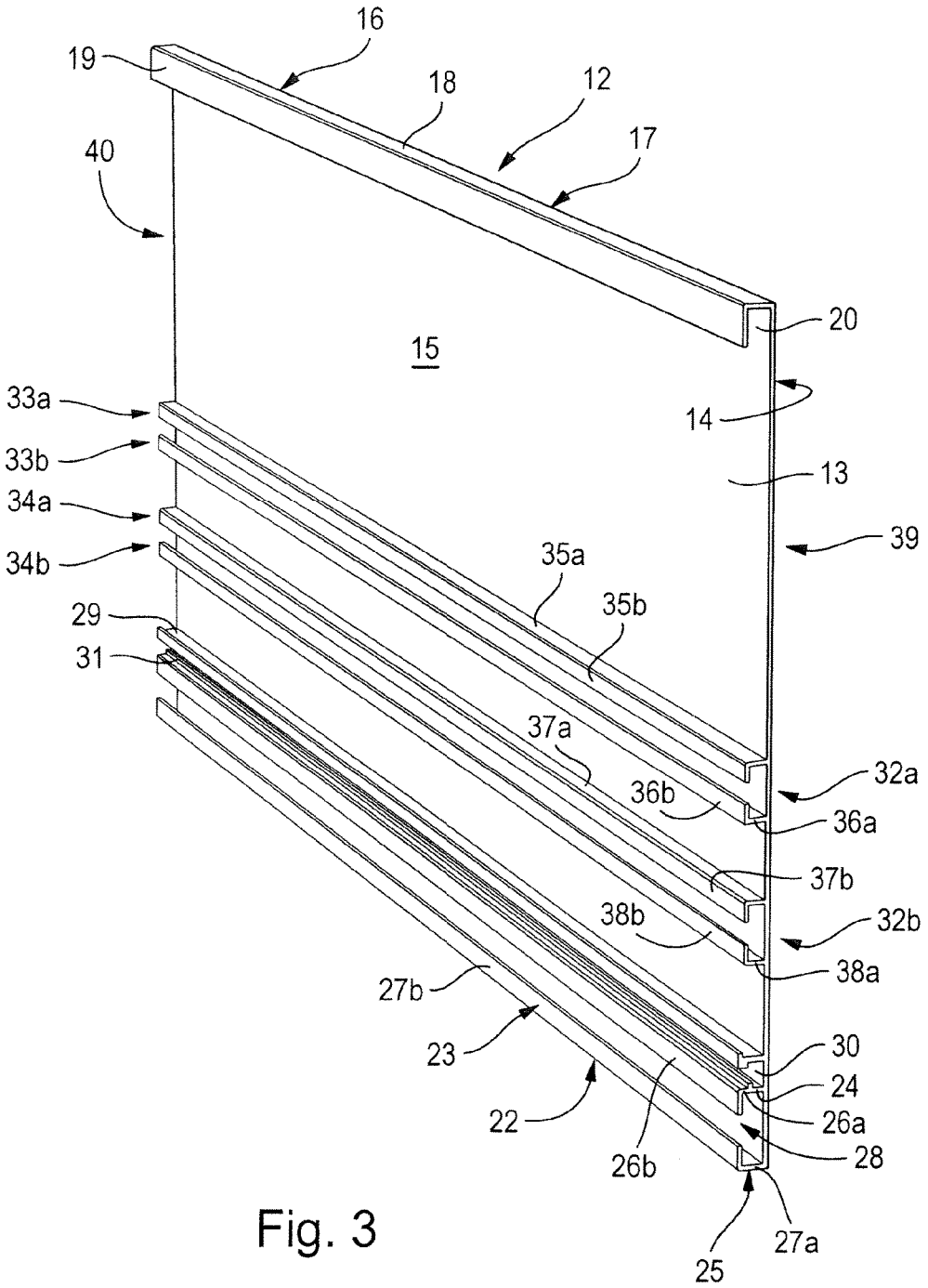
FIG. 3 is a perspective view of a trim profile of the trim profile covering fixture of FIG. 1.

As shown in particular in FIG. 3, the trim profile 12 is designed as a coreless profile, with a panel-shaped base section 13 with a front and rear 14, 15.

Located on the rear side 15 are several function elements which are part of the trim profile covering fixture 11. Attached to the top edge 16 of the base section 13 is a rail-like holding bracket 17 running along the top edge 16. The holding bracket 17 is expediently formed at the same time as the trim profile is produced, in particular as an aluminium extruded profile. The holding bracket 17 has a first leg 18 which extends horizontally from the top edge 16 towards the rear 15, and a second leg 19 which is arranged substantially at right-angles to the first leg and therefore runs parallel to the base section 13. The two legs 18, 19 and the base section 13 form a holding slot 20 for holding functional parts of a side covering element 21, as explained in detail below.

Provided in the area of a bottom edge 22 of the base section 13 is a holding rail 23 with a C-profile-type cross-section. The holding rail 23 extends over the whole width of the base section 13 on its rear side 15. The holding rail 23 is formed by two brackets 24, 25 arranged in mirror-image to one another and each having first legs 26*a*, 27*a* protruding vertically from the rear 15 and aligned parallel and opposite to one another. On each of the two first legs 26*a*, 27*a*, a second leg 26*b*, 27*b* is arranged perpendicular to it. The two brackets 24, 25 and the rear of the base section 13 define a holding slot 28, in which the assigned functional elements on the side covering element 21 may be inserted.

Above the holding rail 23 is a rail 29 extending away from the rear 15 of the base section 13 and forming together with the first leg 26*a* of the first bracket 24 of the holding rail 23, a further holding slot 30. On the top of the first leg 26*a* of the first bracket 24 is a nose-like projection 31, which similarly runs over the whole width of the rear 15 of the base section 13.

Figure 1:
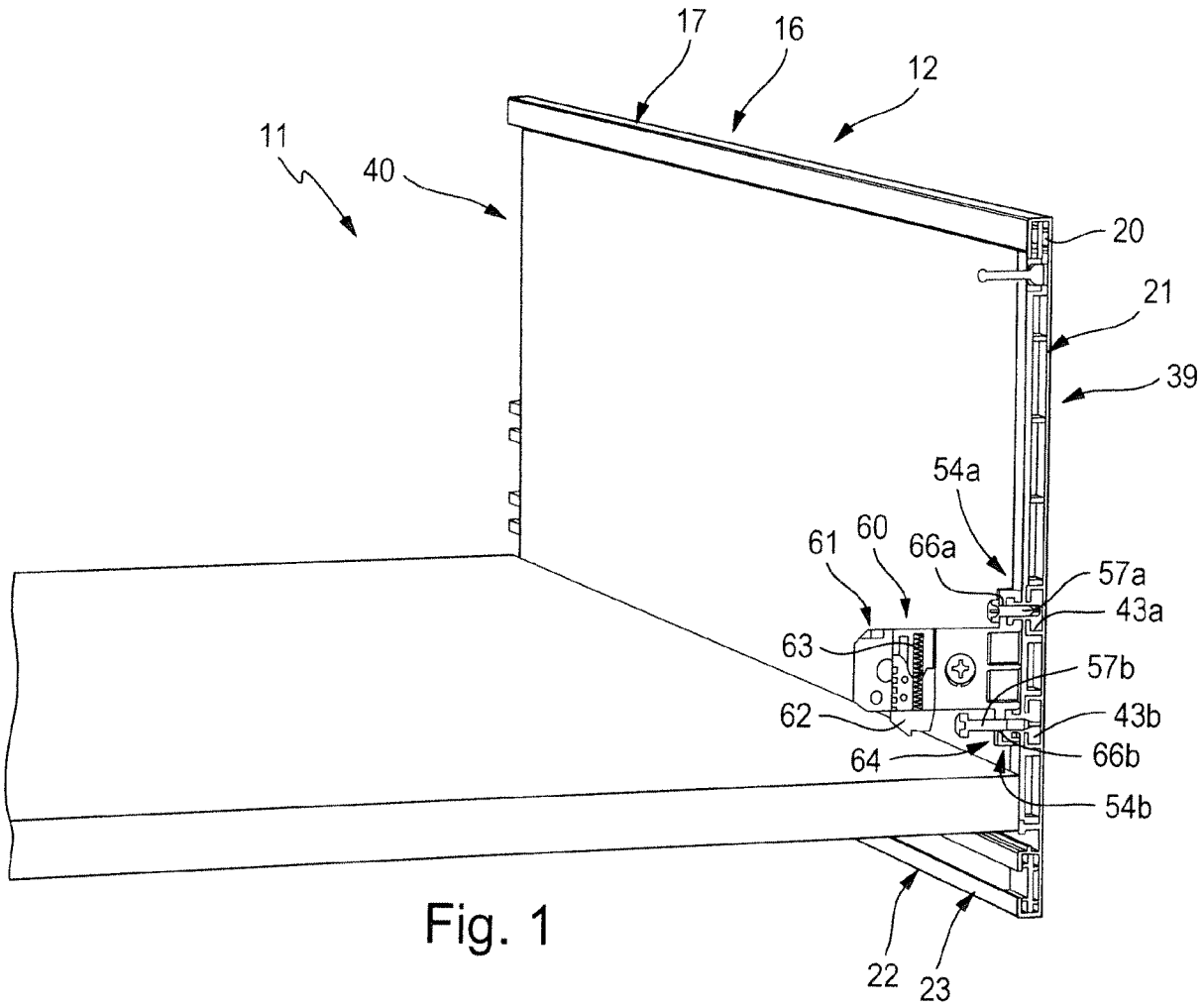
FIG. 1 is a perspective view of a preferred embodiment of the trim profile covering fixture according to the invention with side covering element and trim fastener, wherein a longitudinal section through the side covering element is shown.

A quite important element of the trim profile covering fixture 11 is at least one mounting location formed on the trim profile 12, with two in number being provided in the example. As shown in FIG. 3, the mounting locations 32*a*, 32*b* are each defined by opposed brackets 33*a*, 33*b* and 34*a*, 34*b*, respectively, which extend at the rear 15 of the base section 13 over the entire width of the rear 15. The brackets defining the two mounting locations 32*a*, 32*b* form holding rails configured to receive a mounting projection 43*a*, 43*b* of side covering element 21. Each holding rail has a C-profile-type cross-section like the holding rail 23. In contrast to the holding rail 23, the C-profile-type holding rails of mounting locations 32*a*, 32*b* each have a somewhat smaller cross-section as shown in FIGS. 1 and 3.

Like the holding rail 23, the holding rails of mounting locations 32*a*, 32*b* each have two brackets 33*a*, 33*b*, 34*a*, 34*b*, arranged in mirror-image to one another. The brackets 33*a*, 33*b*, 34*a*, 34*b* each have first legs 35*a*, 36*a*, 37*a*, 38*a*, extending away from the rear 15 of the base section 13. The brackets 33*a*, 33*b*, 34*a*, 34*b* also each have second legs 35*b*, 36*b*, 37*b*, 38*b*, each aligned at right-angles to the first legs 35*a*, 36*a*, 37*a*, 38*a* and running parallel to the rear 15 of the base section 13.

In order to clad and cover the two opposite long sides 39, 40 of the trim profile, two side covering elements 21 are provided, of which only one is shown in FIGS. 1, 2 and 4 to 6.

The side covering elements 21 are multi-functional components. Below, by way of example, only a single side covering element 21 will be described; however the other side covering element assigned to the other long side 40 of the trim profile 12 is identical in design.

The side covering element 21 is rail-like in form and has a base section 41 of elongated design and a rail section 42 which is attached to and joined integrally with a longitudinal edge of the base section 41. As shown in particular in FIG. 2, the rail section 42 forms the side outer termination of the trim profile 12 equipped with the side covering element 21.

Figure 5:
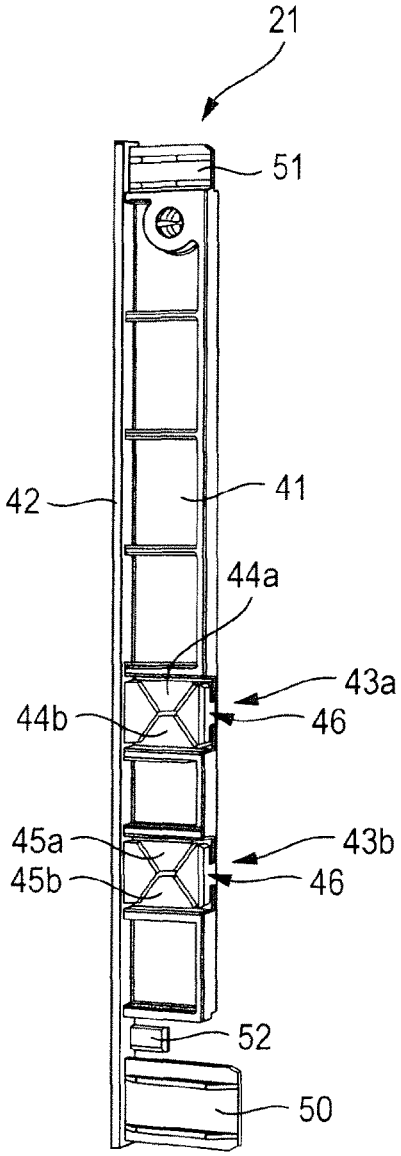
FIG. 5 is a perspective view of the front of the side covering element with the clamping jaws.

As shown in particular in FIG. 5, the side covering element 21 has at least one mounting projection, in the example two mounting projections 43*a*, 43*b*, which may be inserted into the holding rails of the assigned mounting locations 32*a*, 32*b* at the rear of the base section 13 of the trim profile 12. Each of the mounting projections 43*a*, 43*b* has at least one clamping jaw, in the example each has two clamping jaws 44*a*, 44*b*, 45*a*, 45*b*, with each able to be braced by an inside surface of the holding rail of the assigned mounting location 32*a*, 32*b*.

Figure 6:
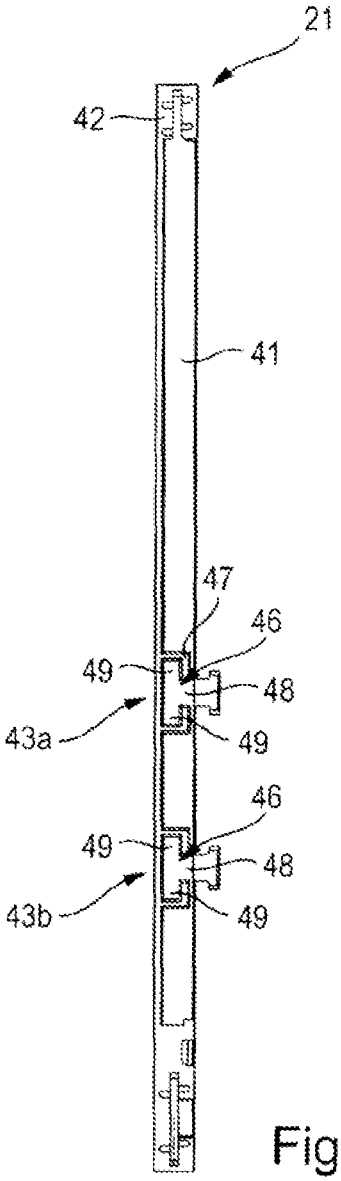
FIG. 6 is an end view of the side covering element along the arrows VI-VI of FIG. 4.

As shown in particular in FIG. 6, each of the mounting projections 43*a*, 43*b* has a base section 46 which is formed in a recess 47 of elongated base section 41 and aligned transversely to the longitudinal axis of the side covering element. Each of the base sections 46 has a T-shaped cross-section, with a neck section 48 and two leg sections 49 oriented opposite to one another and starting from the neck section 48.

As shown in particular in FIG. 5, the clamping jaws 44*a*, 44*b*, 45*a*, 45*b* are mounted on the respective leg sections 49 of the base sections, movable in opposite directions on the respective mounting locations 32*a*, 32*b*. The clamping jaws 44*a*, 44*b*, 45*a*, 45*b* may for example have a trapezoidal shape and be mounted in assigned trapezoidal locations of the leg sections 49. The trapezoidal locations are expediently formed by two leg section areas aligned in mirror-image to one another. Viewed from above, they have a roughly triangular shape, with the apexes of the respective triangles aligned towards one another.

As shown in particular in FIG. 5, the side covering element has in its bottom section a push-in tongue 50, which is mounted on the inside of the rail section 42, from which it protrudes substantially at a right-angle. The push-in tongue 50 may be inserted in the holding rail 23 on the trim profile 12. In the top section of the side covering element 21 is a further push-in tongue 51, which similarly extends away from the inside of the rail section 42 and may be inserted into the holding bracket 17, which is open towards the bottom. Finally the side covering element is also provided with a push-in projection 52, likewise extending away from the inside of the rail section 42. It is significantly smaller than the two other push-in tongues 50, 51 and is used for insertion into the holding slot 30.

Figure 4:
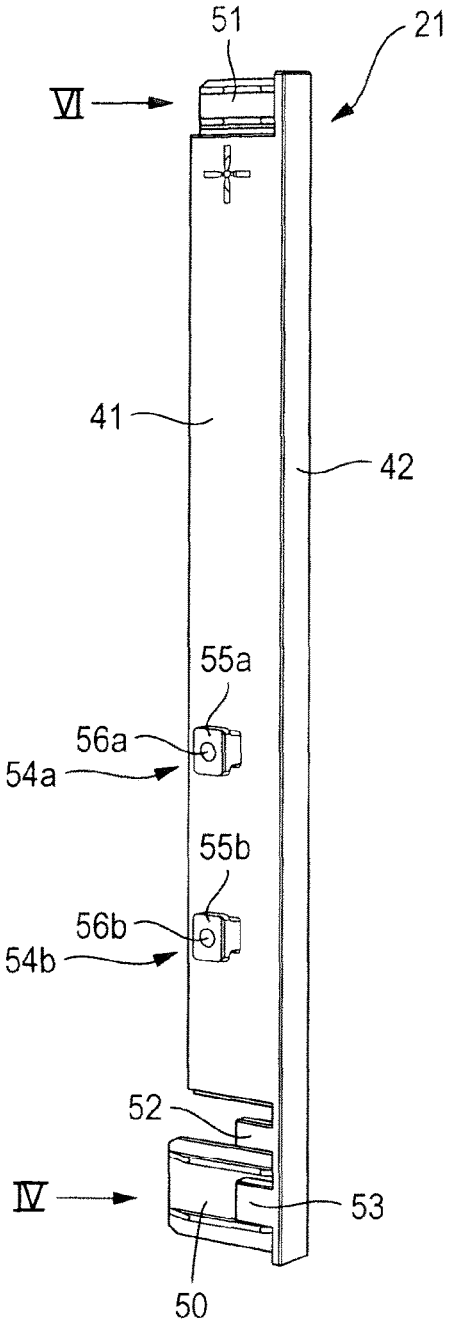
FIG. 4 is a perspective view of the rear of a side covering element.

As shown in particular in FIG. 4, a locating projection 53 is mounted ahead of the large push-in tongue 50 in the direction of width of the rail section 42. The locating projection is wide enough to be held between the two spaced-apart second legs 26*b*, 27*b* of the holding rail 23.

As shown in particular in FIG. 4, the side covering element 21 has at least one mounting interface, in the example two mounting interfaces 54*a*, 54*b*, for the attachment of a trim fastener 60, which in turn is used for fastening the trim profile 12 to a side frame of the drawer. Each of the mounting interfaces 54*a*, 54*b* has mounting projections 55*a*, 55*b*, in particular T-shaped, spaced apart in the vertical direction and sticking out over the side face of the base section 41, with each having a central fixing hole 56*a*, 56*b*. The fixing holes 56*a*, 56*b* open out in each case at the mounting projections 43*a*, 43*b* located at the rear on the base section. The fixing holes 56*a*, 56*b* are so positioned that a fixing screw 57*a*, 57*b* guided through the fixing hole 56*a*, 56*b*, as shown in FIG. 1, may be screwed into the space between the two clamping jaws 44*a*, 44*b*, 45*a*, 45*b*, which may be moved in opposite directions to one another.

Figure 2:
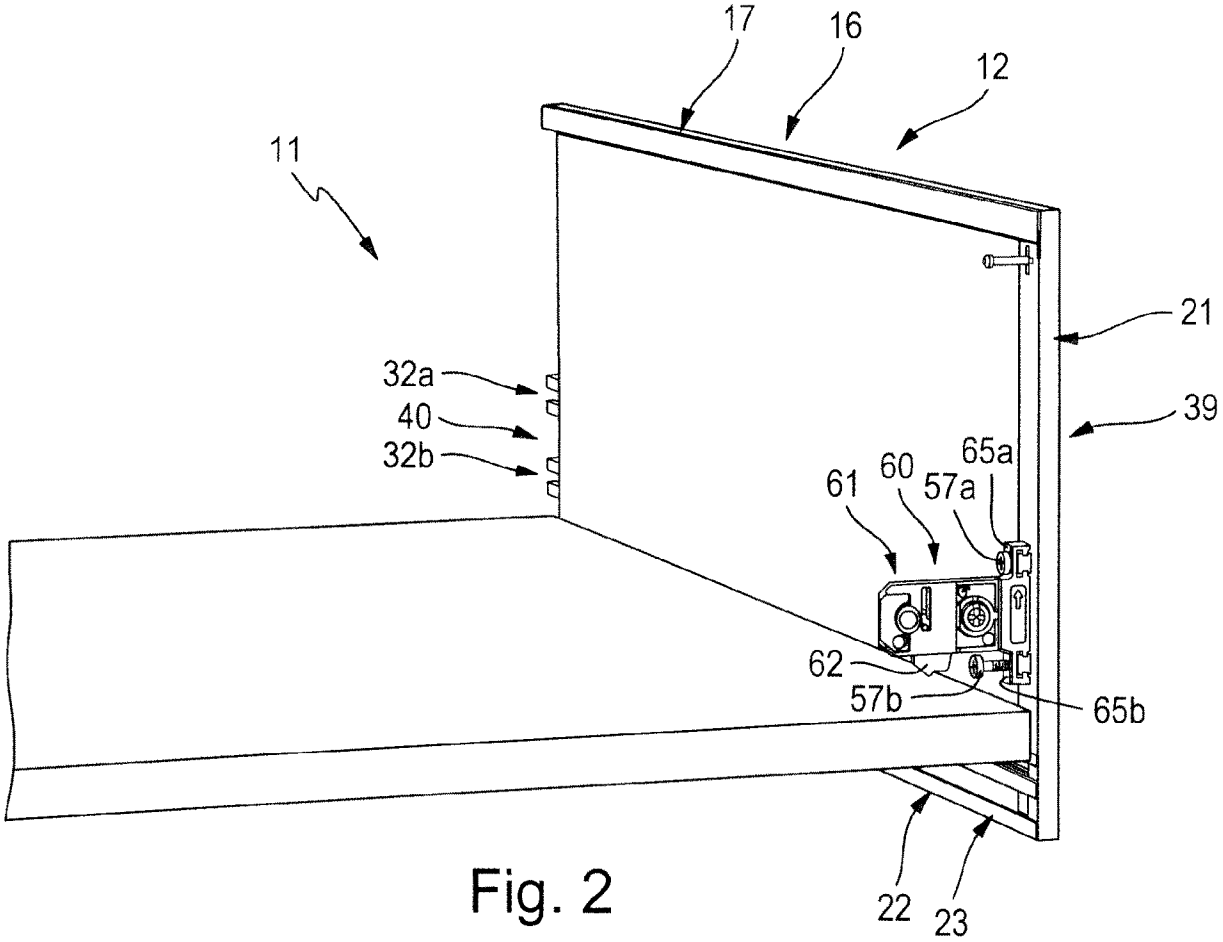
FIG. 2 illustrates the trim profile covering fixture of FIG. 1 in a perspective view, with unsectioned side covering element.

As shown in particular in FIGS. 1 and 2, the trim fastener 60 has a latching section 61, on which a latching element 62 is mounted so as to be movable under the action of an opening spring 63. When the tongue-like latching section 61 is inserted into a latching location provided on the side frame, the latching element 62 is pressed in against the spring force of the opening spring 63 and, with the latching section pushed in completely, engages in a latching recess (not shown). The trim fastener 60 also includes a mounting section 64 which has two mounting legs 65*a*, 65*b* extending out over the width of the latching section 61, and each provided at the top with a mounting hole, and at the bottom with a recess formed on the T-shaped form of the mounting projections 55*a*, 55*b* on the mounting interface 54*a*, 54*b* of the side covering element.

To attach the side covering element 21 it is first guided, with the push-in tongues 50, 51 leading, towards the long side wall 39 of the trim profile which is to be covered. The push-in tongues 50, 51 then run into the assigned holding rail at the bottom edge 22 and at the holding bracket 17, open at the bottom, on the top edge 16 of the trim profile 12. In addition, the push-in projection 52 runs into the holding slot 30. The locating projection 53 is pushed into the space between the two second legs 26*b*, 27*b* of the holding rail. In this way the side covering element 21 is prefixed, but not yet fastened to the trim profile 12. At the same time, the mounting projections 43*a*, 43*b* on the side covering element 21 run into the holding rails of assigned mounting locations 32*a*, 32*b* on the trim profile 12, wherein the respective second legs 35*b*, 36*b*, 37*b*, 38*b* of the holding rails engage behind the leg sections 49 of the mounting projections 43*a*, 43*b*.

The side covering element 21 is a multifunctional component and serves simultaneously via the mounting interfaces 54*a*, 54*b* and the assigned mounting projections 55*a*, 55*b* to fasten the trim fastener 60 thereto. At the same time, the recesses on the mounting section 64 of the trim fastener 60 are pushed sideways on to the mounting projections 55*a*, 55*b* at the mounting interfaces 54*a*, 54*b*, so that they engage the latter from behind. Then the two fixing screws 57*a*, 57*b* are screwed through the mounting holes 66*a*, 66*b* into the mounting legs 65*a*, 65*b*, and through the assigned fixing holes 56*a*, 56*b* are screwed to the mounting projections 55*a*, 55*b*. The fixing screws 57*a*, 57*b* arrive in the space between the two clamping jaws 44*a*, 44*b*, 45*a*, 45*b* which, through the screwing-in of the fixing screws 57*a*, 57*b*, are moved away from one another in opposite directions. This means that the clamping jaws 44*a*, 44*b*, 45*a*, 45*b* arrive with their contact surface at the inside or inside surface of the first leg 35*a*, 36*a*, 37*a*, 38*a* of the bracket of the mounting locations 32*a*, 32*b*, thereby generating clamping, so that the side covering element 21 is fastened to the trim profile 12, secure against being pulled out. At the same time the trim fastener 60 is also fastened to the side covering element 21.

What is claimed is:

1. A trim profile covering fixture, comprising:

at least one elongated side covering element with a longitudinal axis, the side covering element including at least one mounting projection extending transverse to the longitudinal axis, each insertable into and held in an assigned mounting location on a trim profile of a movable furniture component in an inserted state, wherein the assigned mounting location comprises a holding rail formed by opposed brackets extending outward from a rear surface of the trim profile, wherein the at least one side covering element comprises an elongated base section having a length extending in a direction of the longitudinal axis and an elongated rail section transversely connected to a longitudinal edge of the base section, the rail section forming an outer side termination of the trim profile in the inserted state, wherein the elongated base section includes at least one recess aligned transversely to the longitudinal axis, wherein the at least one mounting projection is located within the at least one recess and has opposed clamping jaws configured to be insertable into the holding rail and braced by an inner surface of the opposed brackets, and wherein the at least one side covering element further includes at least one mounting interface located opposite the clamping jaws and extending outward from a side face of the elongated base section.

2. The trim profile covering fixture of claim 1, further comprising at least one trim fastener configured to mount the trim profile on a part of the movable furniture component, and wherein the at least one mounting interface is configured to fix the trim fastener to the trim profile.

3. The trim profile covering fixture of claim 2, wherein the at least one mounting projection has a base section on which the clamping jaws are movably mounted.

4. The trim profile covering fixture of claim 3, wherein the clamping jaws mounted on the base section of the at least one mounting projection are movable in opposite directions to one another.

5. The trim profile covering fixture of claim 3, wherein the opposed brackets of the holding rail, together with the rear surface of the trim profile, form a C-shaped profile in cross-section, and wherein the base section of the at least one mounting projection has a T-shaped cross-section including a neck section and two leg sections oriented opposite to one another starting from the neck section.

6. The trim profile covering fixture of claim 3, wherein the at least one mounting interface is a mounting projection located opposite the clamping jaws and extending outward from the side face of the elongated base section.

7. An assembly comprising the trim profile covering fixture of claim 1 and the trim profile, wherein the trim profile comprises at least one of the mounting locations shaped as a C-profile rail in cross-section, and wherein the C-profile rail includes the opposed brackets arranged in mirror-image to one another which extend outward from the rear surface of the trim profile.

8. The assembly of claim 7, wherein the at least one mounting location comprises two of the mounting locations shaped as a C-profile rail in cross-section, and wherein each C-profile rail includes the opposed brackets arranged in mirror-image to one another which extend outward from the rear surface of the trim profile.

9. The assembly of claim 7, wherein the trim profile further comprises a top edge and a bottom edge, and wherein a rail-shaped holding bracket is connected to the rear surface along the top edge and another holding rail with a C-shape profile in cross-section is provided in an area of the rear surface along the bottom edge for holding functional parts of the at least one side covering element.

10. The assembly of claim 9, wherein the functional parts comprise a push-in tongue at a top section of the at least one side covering element which is insertable into the holding bracket, and a further push-in tongue at a bottom section of the at least one side covering element which is insertable into the another holding rail.

11. The assembly of claim 9, wherein the trim profile further includes a holding slot extending over the rear surface above the another holding rail, and wherein the functional parts further include a push-in tongue smaller than the other push-in tongues which is insertable into the holding slot.

12. The assembly of claim 7, wherein the trim profile covering fixture further includes at least one trim fastener configured to mount the trim profile to a side frame of the movable furniture component, and wherein the at least one trim fastener has a latching section on which a latching element is mounted for insertion into a latching location provided on the side frame.

13. The assembly of claim 12, wherein the at least one trim fastener has a mounting section which includes two mounting legs extending out over a width of the latching section, and wherein each mounting leg is provided with a mounting hole and a recess to enable fixing of the trim fastener to the at least one side covering element.

14. The assembly of claim 13, wherein an actuator extending through the mounting hole and recess effects fixing of the at least one trim fastener to the at least one side covering element.

15. A drawer comprising the trim profile covering fixture of claim 1 and the trim profile, wherein the trim profile has at least one of the mounting locations shaped as a C-profile rail in cross-section, and wherein the C-profile rail includes the opposed brackets arranged in mirror-image to one another which extend outward from the rear surface of the trim profile.

16. A trim profile covering fixture, comprising:

at least one elongated side covering element with a longitudinal axis, the side covering element including at least one mounting projection, each insertable into and held in an assigned mounting location on a trim profile of a movable furniture component in an inserted state, and at least one trim fastener configured to mount the trim profile on a part of the movable furniture component, wherein the assigned mounting location comprises a holding rail formed by opposed brackets extending outward from a rear surface of the trim profile, wherein the at least one side covering element comprises a base section of elongated shape and a rail section connected to a longitudinal edge of the base section, the rail section forming an outer side termination of the trim profile, wherein the base section includes at least one recess aligned transversely to the longitudinal axis, wherein the at least one mounting projection is located within the at least one recess and has opposed clamping jaws configured to be insertable into the holding rail and braced by an inner surface of the opposed brackets, wherein the at least one side covering element further includes at least one mounting interface to fix the trim fastener to the trim profile, and wherein the at least one mounting interface is connected to the at least one mounting projection such that an actuator for bracing of the clamping jaws also effects fixing of the at least one trim fastener to the at least one mounting interface.

17. The trim profile covering fixture of claim 16, wherein the actuator comprises at least one screw.

18. A trim profile covering fixture, comprising:

at least one elongated side covering element with a longitudinal axis, the side covering element including at least one mounting projection, each insertable into and held in an assigned mounting location on a trim profile of a movable furniture component in an inserted state, and at least one trim fastener configured to mount the trim profile on a part of the movable furniture component, wherein the assigned mounting location comprises a holding rail formed by opposed brackets extending outward from a rear surface of the trim profile, wherein the at least one side covering element comprises a base section of elongated shape and a rail section connected to a longitudinal edge of the base section, the rail section forming an outer side termination of the trim profile, wherein the base section of elongated shape includes at least one recess aligned transversely to the longitudinal axis, wherein the at least one mounting projection is located within the at least one recess and has opposed clamping jaws configured to be insertable into the holding rail and braced by an inner surface of the opposed brackets, wherein the at least one side covering element further includes at least one mounting interface to fix the trim fastener to the trim profile, wherein the at least one mounting projection has a base section on which the clamping jaws are movably mounted, and wherein the at least one mounting interface has a fixing hole that extends into the base section of the at least one mounting projection and opens out in an area of the clamping jaws.

* * * * *